US010152006B2

(12) United States Patent
Ishigaya et al.

(10) Patent No.: US 10,152,006 B2
(45) Date of Patent: Dec. 11, 2018

(54) FIXING DEVICE AND IMAGE FORMING APPARATUS

(71) Applicants: Yasunori Ishigaya, Kanagawa (JP); Yutaka Ikebuchi, Kanagawa (JP); Kazuya Saito, Kanagawa (JP); Keitaro Shoji, Kanagawa (JP); Ryohei Matsuda, Kanagawa (JP); Hiromasa Takagi, Tokyo (JP); Ryuuichi Mimbu, Kanagawa (JP); Toshihiko Shimokawa, Kanagawa (JP)

(72) Inventors: Yasunori Ishigaya, Kanagawa (JP); Yutaka Ikebuchi, Kanagawa (JP); Kazuya Saito, Kanagawa (JP); Keitaro Shoji, Kanagawa (JP); Ryohei Matsuda, Kanagawa (JP); Hiromasa Takagi, Tokyo (JP); Ryuuichi Mimbu, Kanagawa (JP); Toshihiko Shimokawa, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 15/160,374

(22) Filed: May 20, 2016

(65) Prior Publication Data

US 2016/0378033 A1 Dec. 29, 2016

(30) Foreign Application Priority Data

Jun. 26, 2015 (JP) ..... 2015-128526
Mar. 4, 2016 (JP) ..... 2016-042030

(51) Int. Cl.
*G03G 15/20* (2006.01)

(52) U.S. Cl.
CPC ... *G03G 15/206* (2013.01); *G03G 2215/0132* (2013.01); *G03G 2215/2035* (2013.01)

(58) Field of Classification Search
CPC ..... G03G 15/2089; G03G 15/2078
See application file for complete search history.

(56) References Cited

U.S. PATENT DOCUMENTS

2007/0071468 A1* 3/2007 Yako ..... G03G 15/5029 399/45
2007/0292175 A1 12/2007 Shinshi
(Continued)

FOREIGN PATENT DOCUMENTS

JP 2007-334205 12/2007
JP 2009-003410 1/2009
(Continued)

OTHER PUBLICATIONS

Machine Translation of JP 2010-032625 A obtained on Nov. 23, 2016.*
(Continued)

*Primary Examiner* — Gregory H Curran
(74) *Attorney, Agent, or Firm* — Oblon, McClelland, Maier & Neustadt, L.L.P.

(57) ABSTRACT

A fixing device includes a rotatable endless belt formed into a loop and a heater disposed opposite the endless belt to heat the endless belt. A nip formation pad is disposed inside the loop formed by the endless belt. The nip formation pad includes a metallic thermal equalizer extending in an axial direction of the endless belt. A rotatable pressure rotator presses against the nip formation pad via the endless belt to form a fixing nip between the endless belt and the pressure rotator, through which a recording medium bearing a toner image is conveyed. The pressure rotator includes an increased tackiness portion disposed at a lateral end of the pressure rotator in an axial direction of the pressure rotator
(Continued)

to transmit a driving force to the endless belt. The increased tackiness portion is disposed opposite the thermal equalizer of the nip formation pad.

19 Claims, 10 Drawing Sheets

(56) References Cited

U.S. PATENT DOCUMENTS

| | | | | |
|---|---|---|---|---|
| 2008/0298862 | A1 | 12/2008 | Shinshi | |
| 2010/0104307 | A1* | 4/2010 | Shinyama | G03G 15/2039 399/68 |
| 2011/0052245 | A1 | 3/2011 | Shinshi et al. | |
| 2011/0182634 | A1* | 7/2011 | Ishigaya | G03G 15/2064 399/328 |
| 2011/0211876 | A1 | 9/2011 | Iwaya et al. | |
| 2012/0177388 | A1 | 7/2012 | Imada et al. | |
| 2012/0177420 | A1 | 7/2012 | Shimokawa et al. | |
| 2012/0177423 | A1 | 7/2012 | Imada et al. | |
| 2013/0170879 | A1 | 7/2013 | Yoshinaga et al. | |
| 2013/0183072 | A1 | 7/2013 | Hase et al. | |
| 2014/0079453 | A1* | 3/2014 | Arai | G03G 15/20 399/329 |
| 2015/0055993 | A1 | 2/2015 | Shoji | |
| 2015/0055994 | A1 | 2/2015 | Shoji et al. | |
| 2015/0110531 | A1 | 4/2015 | Takagi et al. | |
| 2015/0125193 | A1 | 5/2015 | Ishii et al. | |
| 2015/0261155 | A1 | 9/2015 | Yoshiura et al. | |
| 2015/0261157 | A1 | 9/2015 | Yamano et al. | |
| 2015/0268626 | A1 | 9/2015 | Saito et al. | |
| 2016/0004197 | A1 | 1/2016 | Imada et al. | |
| 2016/0011548 | A1 | 1/2016 | Utsunomiya et al. | |
| 2016/0011550 | A1 | 1/2016 | Utsunomiya et al. | |
| 2016/0062286 | A1 | 3/2016 | Yoshiura et al. | |

FOREIGN PATENT DOCUMENTS

| | | | |
|---|---|---|---|
| JP | 2010032625 | A * | 2/2010 |
| JP | 2011-180220 | | 9/2011 |
| JP | 2013-137470 | | 7/2013 |

OTHER PUBLICATIONS

U.S. Appl. No. 14/952,522, filed Nov. 25, 2015.
U.S. Appl. No. 15/010,262, filed Jan. 29, 2016.

* cited by examiner

FIXING DEVICE AND IMAGE FORMING APPARATUS

CROSS-REFERENCE TO RELATED APPLICATIONS

This patent application is based on and claims priority pursuant to 35 U.S.C. § 119 to Japanese Patent Application Nos. 2015-128526, filed on Jun. 26, 2015, and 2016-042030, filed on Mar. 4, 2016, in the Japanese Patent Office, the entire disclosure of each of which is hereby incorporated by reference herein.

BACKGROUND

Technical Field

Exemplary aspects of the present disclosure relate to a fixing device and an image forming apparatus, and more particularly, to a fixing device for fixing a toner image on a recording medium and an image forming apparatus incorporating the fixing device.

Description of the Background

Related-art image forming apparatuses, such as copiers, facsimile machines, printers, or multifunction printers having two or more of copying, printing, scanning, facsimile, plotter, and other functions, typically form an image on a recording medium according to image data. Thus, for example, a charger uniformly charges a surface of a photoconductor; an optical writer emits a light beam onto the charged surface of the photoconductor to form an electrostatic latent image on the photoconductor according to the image data; a developing device supplies toner to the electrostatic latent image formed on the photoconductor to render the electrostatic latent image visible as a toner image; the toner image is directly transferred from the photoconductor onto a recording medium or is indirectly transferred from the photoconductor onto a recording medium via an intermediate transfer belt; finally, a fixing device applies heat and pressure to the recording medium bearing the toner image to fix the toner image on the recording medium, thus forming the image on the recording medium.

Such fixing device may include a fixing rotator, such as a fixing roller, a fixing belt, and a fixing film, heated by a heater and a pressure rotator, such as a pressure roller and a pressure belt, pressed against the fixing rotator to form a fixing nip therebetween through which a recording medium bearing a toner image is conveyed. As the recording medium bearing the toner image is conveyed through the fixing nip, the fixing rotator and the pressure rotator apply heat and pressure to the recording medium, melting and fixing the toner image on the recording medium.

SUMMARY

This specification describes below an improved fixing device. In one exemplary embodiment, the fixing device includes a rotatable endless belt formed into a loop and a heater disposed opposite the endless belt to heat the endless belt. A nip formation pad is disposed inside the loop formed by the endless belt. The nip formation pad includes a metallic thermal equalizer extending in an axial direction of the endless belt. A rotatable pressure rotator presses against the nip formation pad via the endless belt to form a fixing nip between the endless belt and the pressure rotator, through which a recording medium bearing a toner image is conveyed. The pressure rotator includes an increased tackiness portion disposed at a lateral end of the pressure rotator in an axial direction of the pressure rotator to transmit a driving force to the endless belt. The increased tackiness portion is disposed opposite the thermal equalizer of the nip formation pad.

This specification further describes an improved image forming apparatus. In one exemplary embodiment, the image forming apparatus includes an image forming device to form a toner image and a fixing device disposed downstream from the image forming device in a recording medium conveyance direction to fix the toner image on a recording medium. The fixing device includes a rotatable endless belt formed into a loop and a heater disposed opposite the endless belt to heat the endless belt. A nip formation pad is disposed inside the loop formed by the endless belt. The nip formation pad includes a metallic thermal equalizer extending in an axial direction of the endless belt. A rotatable pressure rotator presses against the nip formation pad via the endless belt to form a fixing nip between the endless belt and the pressure rotator, through which the recording medium bearing the toner image is conveyed. The pressure rotator includes an increased tackiness portion disposed at a lateral end of the pressure rotator in an axial direction of the pressure rotator to transmit a driving force to the endless belt. The increased tackiness portion is disposed opposite the thermal equalizer of the nip formation pad.

BRIEF DESCRIPTION OF THE DRAWINGS

A more complete appreciation of the disclosure and the many attendant advantages thereof will be readily obtained as the same becomes better understood by reference to the following detailed description when considered in connection with the accompanying drawings, wherein.

DETAILED DESCRIPTION OF THE DISCLOSURE

Figure 1:
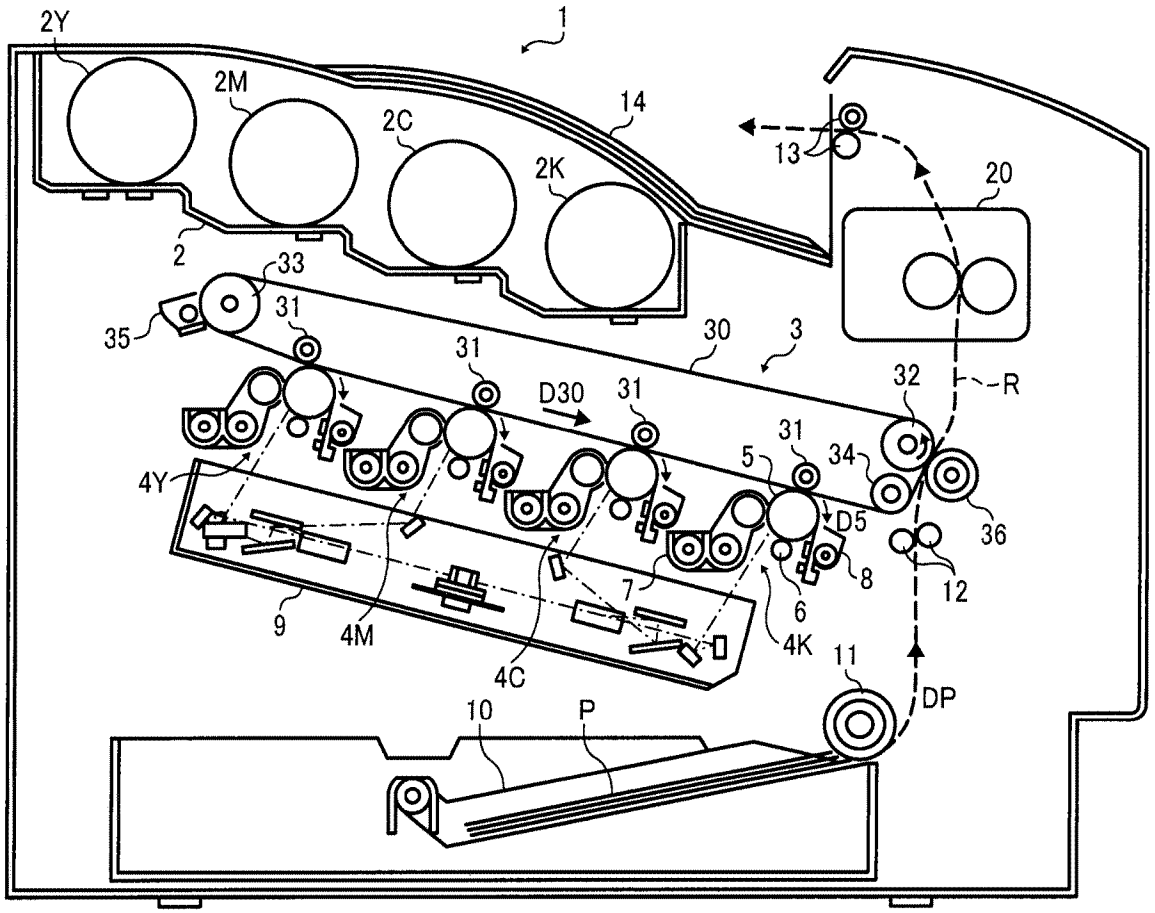
FIG. 1 is a schematic vertical cross-sectional view of an image forming apparatus according to an exemplary embodiment of the present disclosure.

In describing exemplary embodiments illustrated in the drawings, specific terminology is employed for the sake of clarity. However, the disclosure of this specification is not intended to be limited to the specific terminology so selected and it is to be understood that each specific element includes all technical equivalents that operate in a similar manner and achieve a similar result.

Referring now to the drawings, wherein like reference numerals designate identical or corresponding parts throughout the several views, in particular to FIG. 1, an image forming apparatus 1 according to an exemplary embodiment of the present disclosure is explained.

It is to be noted that, in the drawings for explaining exemplary embodiments of this disclosure, identical reference numerals are assigned, as long as discrimination is possible, to components such as members and component parts having an identical function or shape, thus omitting description thereof once it is provided.

FIG. 1 is a schematic vertical cross-sectional view of the image forming apparatus 1. The image forming apparatus 1 may be a copier, a facsimile machine, a printer, a multifunction peripheral or a multifunction printer (MFP) having at least one of copying, printing, scanning, facsimile, and plotter functions, or the like. According to this exemplary embodiment, the image forming apparatus 1 is a color laser printer that forms color and monochrome toner images on a recording medium by electrophotography. Alternatively, the image forming apparatus 1 may be a monochrome printer that forms a monochrome toner image on a recording medium.

Referring to FIG. 1, a description is provided of a construction of the image forming apparatus 1.

As illustrated in FIG. 1, the image forming apparatus 1 includes four image forming devices 4Y, 4M, 4C, and 4K situated in a center portion thereof. Although the image forming devices 4Y, 4M, 4C, and 4K contain developers in different colors, that is, yellow, magenta, cyan, and black corresponding to color separation components of a color image (e.g., yellow, magenta, cyan, and black toners), respectively, they have an identical structure.

For example, each of the image forming devices 4Y, 4M, 4C, and 4K includes a drum-shaped photoconductor 5 serving as an image bearer that carries an electrostatic latent image and a resultant toner image; a charger 6 that charges an outer circumferential surface of the photoconductor 5; a developing device 7 that supplies toner to the electrostatic latent image formed on the outer circumferential surface of the photoconductor 5, thus visualizing the electrostatic latent image as a toner image; and a cleaner 8 that cleans the outer circumferential surface of the photoconductor 5. It is to be noted that, in FIG. 1, reference numerals are assigned to the photoconductor 5, the charger 6, the developing device 7, and the cleaner 8 of the image forming device 4K that forms a black toner image. However, reference numerals for the image forming devices 4Y, 4M, and 4C that form yellow, magenta, and cyan toner images, respectively, are omitted.

Below the image forming devices 4Y, 4M, 4C, and 4K is an exposure device 9 that exposes the outer circumferential surface of the respective photoconductors 5 with laser beams. For example, the exposure device 9, constructed of a light source, a polygon mirror, an f-θ lens, reflection mirrors, and the like, emits a laser beam onto the outer circumferential surface of the respective photoconductors 5 according to image data sent from an external device such as a client computer.

Above the image forming devices 4Y, 4M, 4C, and 4K is a transfer device 3. For example, the transfer device 3 includes an intermediate transfer belt 30 serving as a transferor, four primary transfer rollers 31 serving as primary transferors, and a secondary transfer roller 36 serving as a secondary transferor. The transfer device 3 further includes a secondary transfer backup roller 32, a cleaning backup roller 33, a tension roller 34, and a belt cleaner 35.

The intermediate transfer belt 30 is an endless belt stretched taut across the secondary transfer backup roller 32, the cleaning backup roller 33, and the tension roller 34. As a driver drives and rotates the secondary transfer backup roller 32 counterclockwise in FIG. 1, the secondary transfer backup roller 32 rotates the intermediate transfer belt 30 counterclockwise in FIG. 1 in a rotation direction D30 by friction therebetween.

The four primary transfer rollers 31 sandwich the intermediate transfer belt 30 together with the four photoconductors 5, forming four primary transfer nips between the intermediate transfer belt 30 and the photoconductors 5, respectively. The primary transfer rollers 31 are coupled to a power supply disposed inside the image forming apparatus 1 that applies a predetermined direct current (DC) voltage and/or a predetermined alternating current (AC) voltage thereto.

The secondary transfer roller 36 sandwiches the intermediate transfer belt 30 together with the secondary transfer backup roller 32, forming a secondary transfer nip between the secondary transfer roller 36 and the intermediate transfer belt 30. Similar to the primary transfer rollers 31, the secondary transfer roller 36 is coupled to the power supply that applies a predetermined direct current (DC) voltage and/or a predetermined alternating current (AC) voltage thereto.

The belt cleaner 35 includes a cleaning brush and a cleaning blade that contact an outer circumferential surface of the intermediate transfer belt 30. A bottle holder 2 situated in an upper portion of the image forming apparatus 1 accommodates four toner bottles 2Y, 2M, 2C, and 2K detachably attached thereto to contain and supply fresh yellow, magenta, cyan, and black toners to the developing devices 7 of the image forming devices 4Y, 4M, 4C, and 4K, respectively. For example, the fresh yellow, magenta, cyan, and black toners are supplied from the toner bottles 2Y, 2M, 2C, and 2K to the developing devices 7 through toner supply tubes interposed between the toner bottles 2Y, 2M, 2C, and 2K and the developing devices 7, respectively.

In a lower portion of the image forming apparatus 1 are a paper tray 10 that loads a plurality of sheets P serving as recording media and a feed roller 11 that picks up and feeds a sheet P from the paper tray 10 toward the secondary transfer nip formed between the secondary transfer roller 36 and the intermediate transfer belt 30. The sheets P may be thick paper, postcards, envelopes, plain paper, thin paper, coated paper, art paper, tracing paper, overhead projector (OHP) transparencies, and the like. Optionally, a bypass tray that loads thick paper, postcards, envelopes, thin paper, coated paper, art paper, tracing paper, OHP transparencies, and the like may be attached to the image forming apparatus 1.

A conveyance path R extends from the feed roller 11 to an output roller pair 13 to convey the sheet P picked up from the paper tray 10 onto an outside of the image forming apparatus 1 through the secondary transfer nip. The conveyance path R is provided with a registration roller pair 12 located below the secondary transfer nip formed between the secondary transfer roller 36 and the intermediate transfer belt 30, that is, upstream from the secondary transfer nip in a sheet conveyance direction DP. The registration roller pair 12 serving as a conveyor conveys the sheet P conveyed from the feed roller 11 toward the secondary transfer nip.

The conveyance path R is further provided with a fixing device 20 (e.g., a fuser or a fusing unit) located above the secondary transfer nip, that is, downstream from the secondary transfer nip in the sheet conveyance direction DP. The fixing device 20 fixes an unfixed toner image transferred from the intermediate transfer belt 30 onto the sheet P conveyed from the secondary transfer nip on the sheet P. The conveyance path R is further provided with the output roller pair 13 located above the fixing device 20, that is, downstream from the fixing device 20 in the sheet conveyance direction DP. The output roller pair 13 ejects the sheet P bearing the fixed toner image onto the outside of the image forming apparatus 1, that is, an output tray 14 disposed atop the image forming apparatus 1. The output tray 14 stocks the sheet P ejected by the output roller pair 13.

Referring to FIG. 1, a description is provided of an image forming operation performed by the image forming apparatus 1 having the construction described above to form a full color toner image on a sheet P.

As a print job starts, a driver drives and rotates the photoconductors 5 of the image forming devices 4Y, 4M, 4C, and 4K, respectively, clockwise in FIG. 1 in a rotation direction D5. The chargers 6 uniformly charge the outer circumferential surface of the respective photoconductors 5 at a predetermined polarity. The exposure device 9 emits laser beams onto the charged outer circumferential surface of the respective photoconductors 5 according to yellow, magenta, cyan, and black image data constituting full color image data sent from the external device, respectively, thus forming electrostatic latent images thereon. The image data used to expose the respective photoconductors 5 is monochrome image data produced by decomposing a desired full color image into yellow, magenta, cyan, and black image data. The developing devices 7 supply yellow, magenta, cyan, and black toners to the electrostatic latent images formed on the photoconductors 5, visualizing the electrostatic latent images as yellow, magenta, cyan, and black toner images, respectively.

Simultaneously, as the print job starts, the secondary transfer backup roller 32 is driven and rotated counterclockwise in FIG. 1, rotating the intermediate transfer belt 30 in the rotation direction D30 by friction therebetween. The power supply applies a constant voltage or a constant current control voltage having a polarity opposite a polarity of the charged toner to the primary transfer rollers 31, creating a transfer electric field at each primary transfer nip formed between the photoconductor 5 and the primary transfer roller 31.

When the yellow, magenta, cyan, and black toner images formed on the photoconductors 5 reach the primary transfer nips, respectively, in accordance with rotation of the photoconductors 5, the yellow, magenta, cyan, and black toner images are primarily transferred from the photoconductors 5 onto the intermediate transfer belt 30 by the transfer electric field created at the primary transfer nips such that the yellow, magenta, cyan, and black toner images are superimposed successively on a same position on the intermediate transfer belt 30. Thus, a full color toner image is formed on the outer circumferential surface of the intermediate transfer belt 30. After the primary transfer of the yellow, magenta, cyan, and black toner images from the photoconductors 5 onto the intermediate transfer belt 30, the cleaners 8 remove residual toner failed to be transferred onto the intermediate transfer belt 30 and therefore remaining on the photoconductors 5 therefrom, respectively. Thereafter, dischargers discharge the outer circumferential surface of the respective photoconductors 5, initializing the surface potential thereof.

On the other hand, the feed roller 11 disposed in the lower portion of the image forming apparatus 1 is driven and rotated to feed a sheet P from the paper tray 10 toward the registration roller pair 12 in the conveyance path R. The registration roller pair 12 conveys the sheet P sent to the conveyance path R by the feed roller 11 to the secondary transfer nip formed between the secondary transfer roller 36 and the intermediate transfer belt 30 at a proper time. The secondary transfer roller 36 is applied with a transfer voltage having a polarity opposite a polarity of the charged yellow, magenta, cyan, and black toners constituting the full color toner image formed on the intermediate transfer belt 30, thus creating a transfer electric field at the secondary transfer nip.

As the yellow, magenta, cyan, and black toner images constituting the full color toner image on the intermediate transfer belt 30 reach the secondary transfer nip in accordance with rotation of the intermediate transfer belt 30, the transfer electric field created at the secondary transfer nip secondarily transfers the yellow, magenta, cyan, and black toner images from the intermediate transfer belt 30 onto the sheet P collectively. After the secondary transfer of the full color toner image from the intermediate transfer belt 30 onto the sheet P, the belt cleaner 35 removes residual toner failed to be transferred onto the sheet P and therefore remaining on the intermediate transfer belt 30 therefrom. The removed toner is conveyed and collected into a waste toner container situated inside the image forming apparatus 1.

Thereafter, the sheet P bearing the full color toner image is conveyed to the fixing device 20 that fixes the full color toner image on the sheet P. Then, the sheet P bearing the fixed full color toner image is ejected by the output roller pair 13 onto the outside of the image forming apparatus 1, that is, the output tray 14 that stocks the sheet P.

The above describes the image forming operation of the image forming apparatus 1 to form the full color toner image on the sheet P. Alternatively, the image forming apparatus 1 may form a monochrome toner image by using any one of the four image forming devices 4Y, 4M, 4C, and 4K or may form a bicolor or tricolor toner image by using two or three of the image forming devices 4Y, 4M, 4C, and 4K.

A description is provided of a construction of the fixing device 20 according to a first exemplary embodiment.

Figure 2:
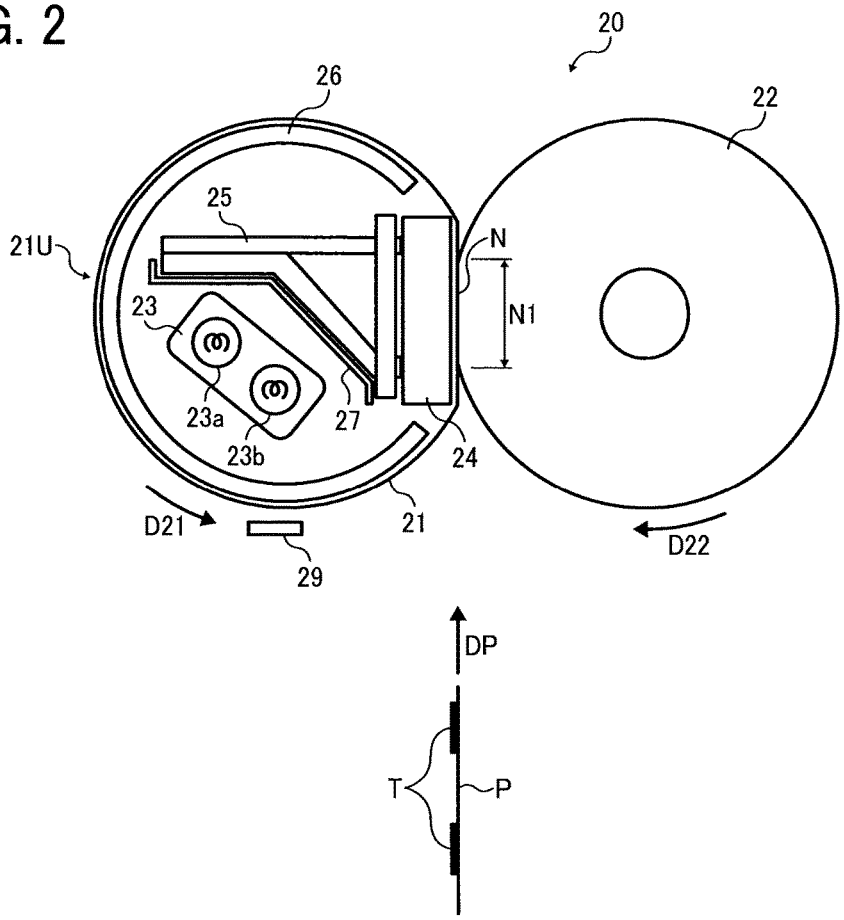
FIG. 2 is a schematic vertical cross-sectional view of a fixing device according to a first exemplary embodiment of the present disclosure that is incorporated in the image forming apparatus depicted in FIG. 1.

FIG. 2 is a schematic vertical cross-sectional view of the fixing device 20. The fixing device 20 includes a fixing belt 21 serving as an endless belt having a decreased thermal capacity and formed into a loop rotatable in a rotation direction D21, a pressure roller 22 serving as a pressure rotator or a pressure member, rotatable in a rotation direction D22, to press against an outer circumferential surface of the fixing belt 21, and a heater 23 disposed inside the loop formed by the fixing belt 21 to heat the fixing belt 21. Inside the loop formed by the fixing belt 21 are a nip formation pad 24, a support 25, and a reflector 27. The components disposed inside the loop formed by the fixing belt 21, that is, the heater 23, the nip formation pad 24, the support 25, and the reflector 27, may constitute a belt unit 21U separably coupled with the pressure roller 22. The nip formation pad 24 presses against the pressure roller 22 via the fixing belt 21 to form a fixing nip N between the fixing belt 21 and the pressure roller 22. The support 25 (e.g., a stay) supports the nip formation pad 24. The reflector 27 is interposed between the heater 23 and the support 25 to reflect radiant heat or light radiated from the heater 23 to the fixing belt 21. Outside the loop formed by the fixing belt 21 is a temperature sensor 29 serving as a temperature detector that detects the temperature of the outer circumferential surface of the fixing belt 21. A holder 26 supports the support 25 and the heater 23 at each lateral end of the support 25 and the heater 23 in a longitudinal direction thereof parallel to an axial direction of the fixing belt 21. Instead of the holder 26 that mounts and supports the support 25 and the heater 23, a side plate of the fixing device 20 may mount and support the support 25 and the heater 23 at each lateral end of the support 25 and the heater 23 in the longitudinal direction thereof. A slide face of the nip formation pad 24 over which the fixing belt 21 slides may mount a low-friction sheet (e.g., a slide sheet).

A detailed description is now given of a configuration of the reflector 27.

The reflector 27 is made of metal or the like having a high melting point. At least a heater side face of the support 25 that is disposed opposite the heater 23 is treated with mirror finishing to reflect light emitted from the heater 23 toward the fixing belt 21, thus preventing radiant heat or light radiated from the heater 23 from heating the support 25 and the like and suppressing waste of energy.

A detailed description is now given of a construction of the heater 23.

The heater 23 includes two heaters, that is, a center heater 23*a* and a lateral end heater 23*b*. The center heater 23*a* includes a center heat generator spanning a center of the heater 23 in the longitudinal direction thereof that is disposed opposite a small sheet P. The lateral end heater 23*b* includes a lateral end heat generator spanning each lateral end of the heater 23 in the longitudinal direction thereof that is disposed opposite a large sheet P. A heating force, that is, a heat generation amount, of the lateral end heater 23*b* is greater than a heating force, that is, a heat generation amount, of the center heater 23*a*. The lateral end heater 23*b* attaining an increased heating force offsets decrease in the temperature of each lateral end of the fixing belt 21 in the axial direction thereof due to heat dissipation. Alternatively, the heater 23 may include a single heater or three heaters. For example, the number of coiling of a filament of the heater 23 per unit length is changed to adjust the heat generation amount of the heater 23. The heater 23 may be a halogen heater. Alternatively, the heater 23 may be an induction heater (IH), a resistive heat generator, a carbon heater, or the like. A separator is disposed downstream from the fixing nip N in the sheet conveyance direction DP to separate the sheet P from the fixing belt 21. Since the separator is a minor component that does not relate to an advantageous configuration of this disclosure directly, a description of a configuration of the separator is omitted.

Figure 3:
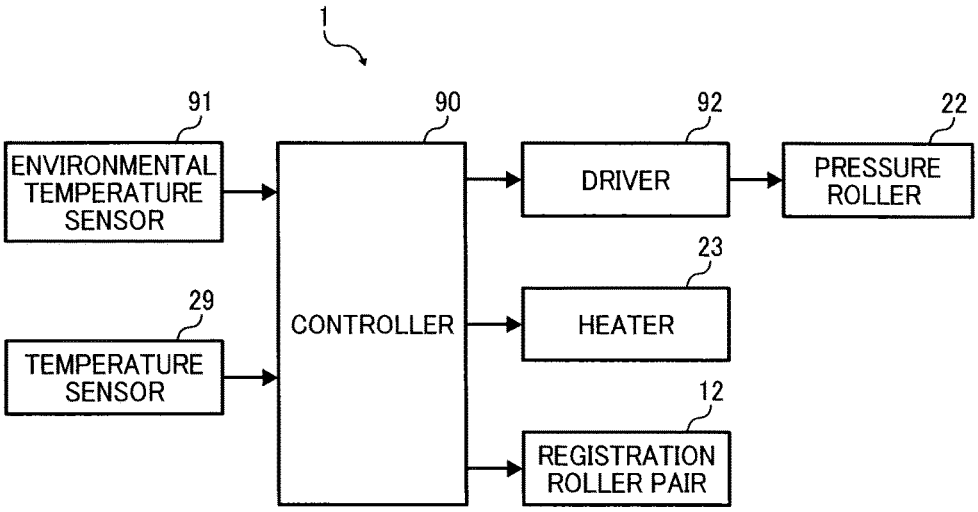
FIG. 3 is a block diagram of the image forming apparatus depicted in FIG. 1.

FIG. 3 is a block diagram of the image forming apparatus 1. As illustrated in FIG. 3, an environmental temperature sensor 91 detects the temperature of an environment (e.g., an ambient temperature). A controller 90 (e.g., a processor), that is, a central processing unit (CPU) provided with a random-access memory (RAM) and a read-only memory (ROM), for example, controls a driver 92 to change the rotation speed of the pressure roller 22 based on the temperature of the environment detected by the environmental temperature sensor 91 so that the rotation speed of the pressure roller 22 while warming up the fixing device 20 is slower than the rotation speed of the pressure roller 22 while fixing a toner image T on a sheet P or while printing. The controller 90 may be disposed inside the fixing device 20 or the image forming apparatus 1. It is attributed to an advantageous configuration to heat the pressure roller 22 through the nip formation pad 24 incorporating a thermal equalizer as described below. Unlike a case in which an interior heater disposed inside the pressure roller 22 heats the pressure roller 22 directly or the heater 23 heats the pressure roller 22 through the fixing belt 21 having a decreased thermal capacity, an increased tackiness portion of the pressure roller 22 is heated slowly while the pressure roller 22 is heated from a low temperature and the pressure roller 22 is susceptible to slippage with respect to the fixing belt 21. When the pressure roller 22 slips over the fixing belt 21, the fixing belt 21 may rotate slowly or halt. The halted fixing belt 21 is heated by the heater 23 locally, resulting in abnormal temperature increase of the fixing belt 21 per unit time due to the decreased thermal capacity of the fixing belt 21. Accordingly, the fixing belt 21 may be damaged thermally. To address this circumstance, the controller 90 decreases the rotation speed of the pressure roller 22 until the thermal equalizer is warmed up while the pressure roller 22 is warmed up from the low temperature. The controller 90 may determine whether or not the pressure roller 22 is being warmed up according to an operation history of the fixing device 20 and an elapsed time after the fixing device 20 is powered on instead of the temperature of the environment detected by the environmental temperature sensor 91.

The lower the detected temperature of the environment or the temperature of the fixing device 20 is, the longer a warm-up time or a heating time to heat the fixing device 20 is. Accordingly, the controller 90 rotates the pressure roller 22 slowly at a decreased rotation speed longer for an increased time. For example, when the fixing device 20 is heated from 20 degrees centigrade, the pressure roller 22 is rotated slowly for 5 seconds. Conversely, when the fixing device 20 is heated from 10 degrees centigrade, the pressure roller 22 is rotated longer for 10 seconds.

A detailed description is now given of a construction of the fixing belt 21.

Like film, the fixing belt 21 is a thin, flexible endless belt having a decreased loop diameter to achieve the decreased thermal capacity. For example, the fixing belt 21 is constructed of a base layer constituting an inner circumferential surface of the fixing belt 21 and a release layer constituting the outer circumferential surface of the fixing belt 21. The base layer is made of metal such as SUS stainless steel or resin such as polyimide (PI). The release layer is made of tetrafluoroethylene-perfluoroalkylvinylether copolymer (PFA), polytetrafluoroethylene (PTFE), or the like. Optionally, an elastic layer made of rubber such as silicone rubber, silicone rubber foam, and fluoro rubber may be interposed between the base layer and the release layer. While the fixing belt 21 and the pressure roller 22 pressingly sandwich the unfixed toner image T on the sheet P to fix the toner image T on the sheet P, the elastic layer having a thickness of 100 micrometers elastically deforms to absorb slight surface asperities of the fixing belt 21, preventing variation in gloss of the toner image T on the sheet P. For example, the fixing belt 21 is constructed of the base layer having a thickness in a range of from 20 micrometers to 50 micrometers; the elastic layer having a thickness in a range of from 100 micrometers to 300 micrometers; and the release layer having a thickness in a range of from 10 micrometers to 50 micrometers. Thus, the fixing belt 21 has a total thickness not greater than 1 mm. A loop diameter of the fixing belt 21 is in a range of from 20 mm to 40 mm.

A description is provided of a configuration of a comparative fixing device.

The comparative fixing device includes an endless fixing belt having a decreased thermal capacity and being heated by a heater directly.

The fixing belt having the decreased thermal capacity may suffer from temperature increase or overheating at each lateral end of the fixing belt in an axial direction thereof. A conveyance span of the fixing belt where a small sheet is conveyed is immune from overheating because the small sheet draws heat from the conveyance span of the fixing belt. Conversely, a non-conveyance span of the fixing belt where the small sheet is not conveyed may overheat because the small sheet does not draw heat from the non-conveyance span of the fixing belt. Accordingly, heat may accumulate on the non-conveyance span of the fixing belt, a nip formation pad abutting the fixing belt, a support supporting the nip formation pad, and the like. Consequently, the non-conveyance span of the fixing belt at a fixing nip formed between the fixing belt and a pressure roller pressed against the fixing belt may overheat to a temperature higher than a predetermined temperature (e.g., a fixing temperature at which a toner image is fixed on a sheet properly). After a plurality of small sheets is conveyed over the fixing belt continuously, each lateral end of the fixing belt in the axial direction thereof may overheat, thermally degrading the components disposed inside the comparative fixing device including the pressure roller heated by the heater through the fixing belt at the fixing nip.

On the other hand, the fixing belt having the decreased thermal capacity includes thin film. In order to rotate the thin fixing belt stably, a driving force is requested to be transmitted from the pressure roller to the fixing belt contacted by the pressure roller at the fixing nip precisely. To address this request, an outer circumferential surface of the pressure roller is made of a material having an increased slide resistance between the fixing belt and the pressure roller that slides over the fixing belt. However, the increased slide resistance may increase a surface tackiness of the outer circumferential surface of the pressure roller. The increased surface tackiness of the pressure roller may adhere residual toner transferred from a toner image on a sheet onto the endless belt and remaining on the fixing belt to the pressure roller. While a subsequent sheet is conveyed through the fixing nip, the toner adhered to the pressure roller may move to a back side of the subsequent sheet, staining the subsequent sheet.

To address this circumstance, the conveyance span of the pressure roller, that is, a center span of the pressure roller in an axial direction thereof, which may bear the toner is coated with a PFA tube having a decreased tackiness. Conversely, in each lateral end span of the pressure roller in the axial direction thereof, a solid rubber layer underneath the PFA tube is exposed to produce an increased tackiness portion, thus facilitating transmission of the driving force from the pressure roller to the fixing belt to offset shortage of transmission of the driving force in the center span of the pressure roller.

If the increased tackiness portion of the pressure roller is made of solid rubber, the pressure roller is heated to a predetermined temperature or higher to attain a sufficient tackiness of the solid rubber. However, if the heater is configured to heat the pressure roller, the increased tackiness portion of the pressure roller may be under high temperature for a long time. If the solid rubber is under high temperature excessively, the organization of the solid rubber may be hardened and the tackiness of the solid rubber may decrease. As the solid rubber is hardened further, the solid rubber may be cracked and damaged. That is, it is necessary to heat the increased tackiness portion of the pressure roller. However, if the increased tackiness portion of the pressure roller is under high temperature excessively, the increased tackiness portion may suffer from failure.

A detailed description is now given of a construction of the pressure roller 22.

As illustrated in FIG. 2, the pressure roller 22 is constructed of a cored bar; an elastic layer coating the cored bar and made of solid rubber, silicone rubber foam, fluoro rubber, or the like; and a release layer coating the elastic layer and made of PFA, PTFE, or the like and spanning a maximum conveyance span in an axial direction of the pressure roller 22 where a maximum sheet P available in the image forming apparatus 1 is conveyed.

Outboard from the maximum conveyance span in the axial direction of the pressure roller 22 is the increased tackiness portion (e.g., a grip portion) disposed at each lateral end of the pressure roller 22 in the axial direction thereof. The increased tackiness portion does not have the release layer and therefore exposes the elastic layer. The increased tackiness portion exposing the elastic layer catches the sheet P more precisely than the release layer that nips the sheet P together with the fixing belt 21. The increased tackiness portion has a surface that achieves an increased friction coefficient to grip the sheet P precisely. Since the release layer spanning the maximum conveyance span is mounted on the elastic layer and presses against the elastic layer slightly, an outer circumferential surface of the increased tackiness portion is substantially leveled with an outer circumferential surface of the release layer to define a plane in the axial direction of the pressure roller 22.

A spring or the like presses the pressure roller 22 against the fixing belt 21 to form the fixing nip N. The pressure roller 22 pressingly contacting the fixing belt 21 deforms the elastic layer of the pressure roller 22 at the fixing nip N formed between the pressure roller 22 and the fixing belt 21, thus defining the fixing nip N having a predetermined length N1 in the sheet conveyance direction DP. The maximum conveyance span is also mentioned as a conveyance span containing at least a span encompassing a dimensional error of the pressure roller 22 in the axial direction thereof installed in the fixing device 20 and positional deviation of the sheet P in a main scanning direction, that is, the axial direction of the pressure roller 22, while the sheet P is conveyed over the pressure roller 22 in addition to a desired span where the sheet P is conveyed through the fixing nip N properly.

The driver 92 (e.g., a motor) depicted in FIG. 3 that is disposed inside the image forming apparatus 1 depicted in FIG. 1 drives and rotates the pressure roller 22. As the driver 92 drives and rotates the pressure roller 22, a driving force of the driver 92 is transmitted from the pressure roller 22 to the fixing belt 21 at the fixing nip N, thus rotating the fixing belt 21 in accordance with rotation of the pressure roller 22 by friction between the pressure roller 22 and the fixing belt 21. At the fixing nip N, the fixing belt 21 is applied with the driving force that rotates the fixing belt 21 in the rotation direction D21 while the fixing belt 21 is sandwiched between the nip formation pad 24 and the pressure roller 22. Conversely, at a position other than the fixing nip N, the fixing belt 21 is supported by a flange of the holder 26 at each lateral end of the fixing belt 21 in the axial direction thereof, like the support 25 and the heater 23.

According to this exemplary embodiment, the pressure roller 22 is a solid roller. Alternatively, the pressure roller 22 may be a hollow roller. Regardless of whether the pressure roller 22 is the solid roller or the hollow roller, the pressure roller 22 is heated by the heater 23 through the fixing belt 21. The power supply situated inside the image forming apparatus 1 supplies power to the heater 23 so that the heater 23 generates heat. The controller 90 operatively connected to the heater 23 and the temperature sensor 29 controls the heater 23 based on the temperature of the outer circumferential surface of the fixing belt 21 detected by the temperature sensor 29 disposed opposite the outer circumferential surface of the fixing belt 21. Thus, the temperature of the fixing belt 21 is adjusted to a desired fixing temperature.

A detailed description is now given of a construction of the nip formation pad 24.

The nip formation pad 24 extending in a longitudinal direction thereof parallel to the axial direction of the fixing belt 21 is secured to and supported by the support 25. Accordingly, even if the nip formation pad 24 receives pressure from the pressure roller 22, the nip formation pad 24 is not bent by the pressure and therefore produces the uniform nip length N1 throughout the entire width of the pressure roller 22 in the axial direction thereof. The nip formation pad 24 is made of a heat resistant material being resistant against temperatures not lower than about 200 degrees centigrade and having an increased mechanical strength. Thus, the nip formation pad 24 is immune from thermal deformation at temperatures in a fixing temperature range desirable to fix the toner image T on the sheet P, retaining the shape of the fixing nip N and quality of the toner image T formed on the sheet P.

Figure 4:
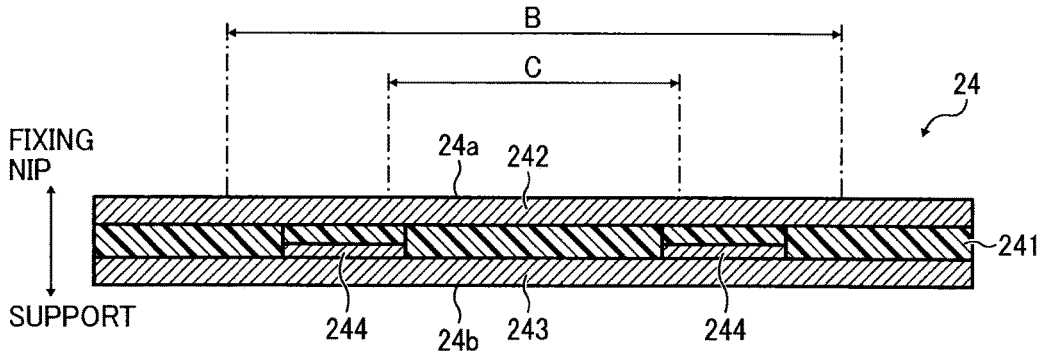
FIG. 4 is a cross-sectional view of a nip formation pad incorporated in the fixing device depicted in FIG. 2.
Figure 5:
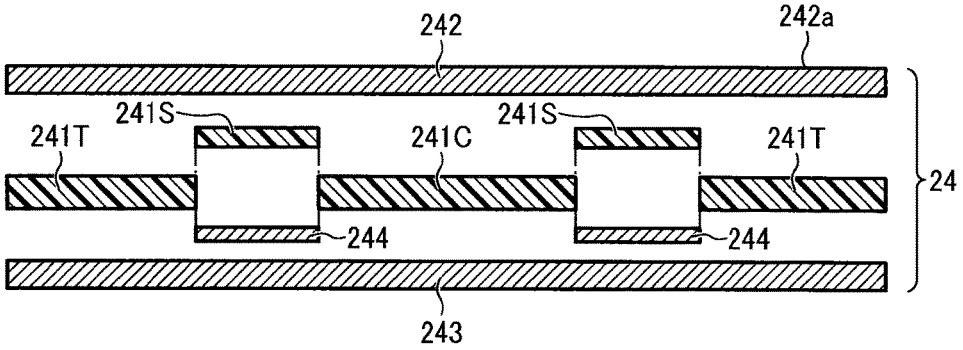
FIG. 5 is an exploded view of the nip formation pad depicted in FIG. 4.
Figure 6:
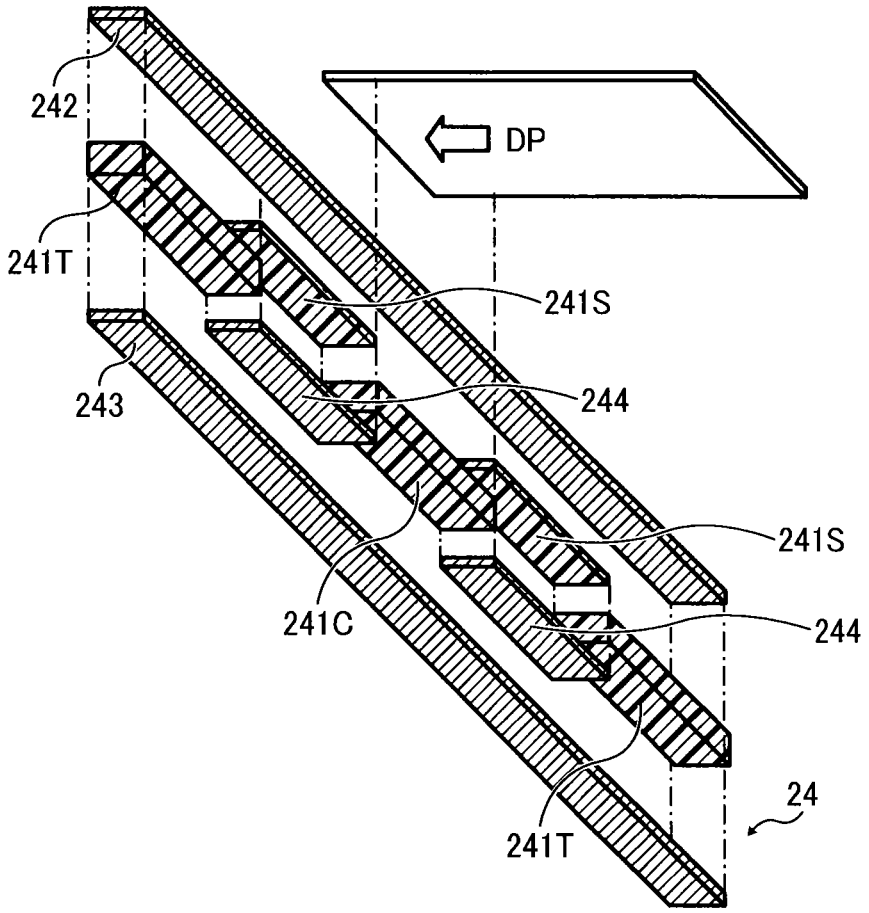
FIG. 6 is a schematic exploded perspective view of the nip formation pad depicted in FIG. 4.

FIG. 4 is a cross-sectional view of the nip formation pad 24 seen in the sheet conveyance direction DP. FIG. 4 illustrates a cross-section of the nip formation pad 24 taken substantially at a center of the fixing nip N in the axial direction of the fixing belt 21. A horizontal direction in FIG. 4 is the longitudinal direction of the nip formation pad 24. In FIG. 4, an upper end of the nip formation pad 24 is disposed opposite the fixing nip N. A lower end of the nip formation pad 24 is disposed opposite the support 25. A conveyance span B corresponds to a width of the large sheet P, that is, the maximum size sheet available in the fixing device 20 (e.g., an A3 size sheet in portrait orientation). A conveyance span C corresponds to a width of the small sheet P (e.g., an A4 size sheet in portrait orientation). FIG. 5 is an exploded view of the nip formation pad 24 depicted in FIG. 4. FIG. 6 is a schematic exploded perspective view of the nip formation pad 24 depicted in FIG. 4.

As illustrated in FIGS. 4 to 6, the nip formation pad 24 includes a base 241 and a plurality of thermal equalizers 242, 243, and 244. The thermal equalizer 242 is disposed opposite the fixing nip N and the pressure roller 22 via the fixing belt 21. The thermal equalizer 243 is disposed opposite the support 25 and extended in the axial direction of the fixing belt 21. The thermal equalizer 244 is interposed between the thermal equalizers 242 and 243. The thermal equalizers 242, 243, and 244 facilitate heat conduction in the axial direction of the fixing belt 21, thus also mentioned as a supplementary heat conductor.

As illustrated in FIGS. 5 and 6, the base 241 includes a center portion 241C, two lateral end portions 241T, and two bridge portions 241S. For example, the base 241 is made of general heat resistant resin such as polyether sulfone (PES), polyphenylene sulfide (PPS), polyether nitrile (PEN), and polyamide imide (PAI), thus having a thermal conductivity smaller than a thermal conductivity of the thermal equalizers 242 to 244.

The thermal equalizers 242 to 244 are made of metal having an increased thermal conductivity such as copper (Cu) and aluminum (Al), thus attaining an increased thermal conductivity. The thermal equalizer 242 disposed opposite the fixing nip N receives heat from the fixing belt 21 directly. If the low-friction sheet is sandwiched between the fixing belt 21 and the nip formation pad 24, the thermal equalizer 242 receives heat from the fixing belt 21 through the low-friction sheet. The thermal equalizer 242 extends in a width direction of the sheet P parallel to the axial direction of the fixing belt 21. Accordingly, even if a plurality of small sheets P is conveyed over the fixing belt 21 continuously and therefore a non-conveyance span of the fixing belt 21 where the plurality of small sheets P is not conveyed overheats because the plurality of small sheets P does not draw heat from the non-conveyance span of the fixing belt 21, the thermal equalizer 242 conducts and diffuses heat in the axial direction of the fixing belt 21 effectively. On the other hand, before a sheet P is conveyed over the fixing belt 21, the thermal equalizer 242 conducts and diffuses heat from a center to each lateral end of the fixing belt 21 in the axial direction thereof, offsetting temperature decrease caused by heat dissipation from each lateral end of the fixing belt 21. Additionally, the thermal equalizer 242 facilitates heat supply to the pressure roller 22, particularly, the increased tackiness portion of the pressure roller 22, while suppressing increase in temperature distribution in the axial direction of the pressure roller 22.

As illustrated in FIG. 4, the support (e.g., stay) side, thermal equalizer 243 includes a support side face 24*b* being opposite a fixing nip side face 24*a* of the nip formation pad 24 and in contact with the support 25 depicted in FIG. 2. The intermediate, thermal equalizer 244 is sandwiched between the support side, thermal equalizer 243 and the base 241, specifically, the bridge portion 241S of the base 241 depicted in FIG. 5. The intermediate thermal equalizer 244 is disposed opposite each lateral end of the small sheet P (e.g., the A4 size sheet in portrait orientation) in the axial direction of the fixing belt 21. For example, an inboard end of the intermediate thermal equalizer 244 directed to the center of the fixing belt 21 in the axial direction thereof is disposed opposite or overlaps a lateral end of a small sheet conveyance span of the small sheet P conveyed over the fixing belt 21. Accordingly, even if each lateral end or a vicinity of the small sheet conveyance span of the small sheet P overheats after the plurality of small sheets P is conveyed over the fixing belt 21, the intermediate thermal equalizer 244 conducts heat to the support side, thermal equalizer 243 effectively, thus diffusing and absorbing heat in the width direction of the sheet P and a thickness direction of the nip formation pad 24.

A part of the base 241 that accommodates the intermediate thermal equalizer 244 has a decreased thickness vertically in FIG. 4. As illustrated in FIGS. 4 and 5, a combined thickness combining a thickness of the bridge portion 241S of the base 241 and a thickness of the intermediate thermal equalizer 244 layered on the bridge portion 241S is equivalent to a thickness of the center portion 241C of the base 241.

The greater the thickness of each of the thermal equalizers 242 to 244 is, the more effectively the thermal equalizers 242 to 244 prevent overheating of each lateral end of the fixing belt 21 in the axial direction thereof. However, if the thickness of each of the thermal equalizers 242 to 244 is excessively great, the fixing device 20 is warmed up slowly, degrading energy efficiency. To address this circumstance, according to this exemplary embodiment, the support side, thermal equalizer 243 has a thickness of 2 mm. The intermediate thermal equalizer 244 has a thickness of 1.5 mm. The fixing nip side, thermal equalizer 242 has a thickness of 0.6 mm.

Regarding the base 241, the bridge portion 241S has a thickness of 1 mm. The center portion 241C has a thickness of 2.5 mm that is equivalent to the combined thickness combining the thickness of the bridge portion 241S and the thickness of the intermediate thermal equalizer 244. The length of the nip formation pad 24 in the longitudinal direction thereof, that is, the length of each of the thermal equalizers 242 and 243, is defined such that the nip formation pad 24 bridges a lateral end heat generator defining a lateral end heat generation span of the lateral end heater 23*b* corresponding to the large sheet P and a non-heat generation span disposed outboard from the lateral end heat generation span in the longitudinal direction of the heater 23.

Accordingly, the nip formation pad 24 moves heat accumulated excessively at the fixing nip N in a center heat generation span of the center heater 23*a* and the lateral end heat generation span of the lateral end heater 23*b* to the non-heat generation span, allowing the heat to be conducted to the increased tackiness portion of the pressure roller 22. Since the increased tackiness portion of the pressure roller 22 is supplied with a decreased amount of heat compared to a configuration in which the pressure roller 22 is heated by a heater directly, the increased tackiness portion of the pressure roller 22 is immune from overheating and resultant failure. When the increased tackiness portion of the pressure roller 22 suffers from temperature increase, heat dissipates from each lateral end of the thermal equalizer 242 outward in the longitudinal direction of the nip formation pad 24.

FIGS. 4 to 6 exaggerate the thickness direction of the nip formation pad 24 relative to the longitudinal direction thereof. Since FIGS. 4 to 6 schematically illustrate the construction of the nip formation pad 24, the dimension of each of the components of the nip formation pad 24 illustrated in FIGS. 4 to 6, including the dimension in the longitudinal direction of the nip formation pad 24, is not shrinkage of the actual components. The base 241 illustrated in FIGS. 4 to 6 is divided into the plurality of portions to accommodate the intermediate thermal equalizer 244. Alternatively, each of the base 241 and the thermal equalizers 242 to 244 may be a separate plate. Yet alternatively, the base 241 and the thermal equalizers 242 to 244 may be molded into a single component having a projection and a recess.

Instead of the three layers, the nip formation pad 24 may be constructed of a single plate, that is, the thermal equalizer 242. Since the support 25 supports the nip formation pad 24 entirely in the longitudinal direction thereof, the thermal equalizer 242 incorporated in the nip formation pad 24 having the three layers may be used as the single plate without changing the dimension, thus saving the material of the nip formation pad 24 and sparing a space inside the loop formed by the fixing belt 21.

Figure 7:
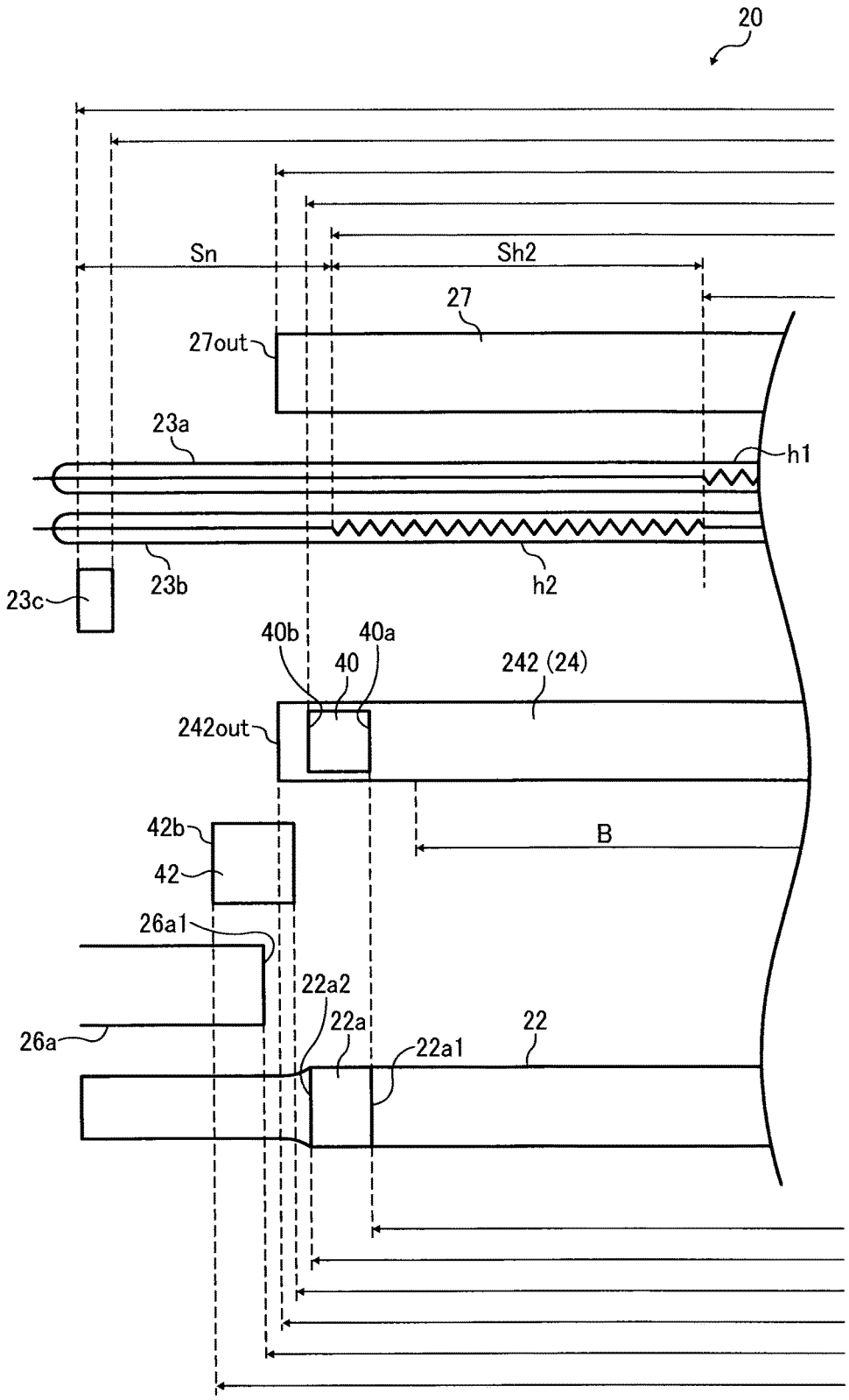
FIG. 7 is a partial exploded view of the fixing device depicted in FIG. 2 illustrating a pressure roller.

FIG. 7 is a partial exploded view of the fixing device 20 illustrating a positional relation between the thermal equalizer 242 of the nip formation pad 24, the reflector 27, a flange 26*a* of the holder 26, the center heater 23*a*, the lateral end heater 23*b*, a grip portion 22*a* serving as the increased tackiness portion of the pressure roller 22, and the like. In a description below, the center and each lateral end of the fixing belt 21 in the axial direction thereof are also mentioned as an inboard section and an outboard section of the fixing belt 21 in the axial direction thereof, respectively.

As illustrated in FIG. 7, the lateral end heater 23*b* (e.g., a halogen heater) includes a lateral end heat generator h2, that is, a filament coiled densely and continuously in a longitudinal direction of the lateral end heater 23*b*, that defines a lateral end heat generation span Sh2 of the lateral end heater 23*b*. The thermal equalizer 242 includes an outboard end 242out disposed at each lateral edge of the thermal equalizer 242 in a longitudinal direction thereof. The outboard end 242out is disposed within a span from an outboard edge of the lateral end heat generation span Sh2 to a non-heat generation span Sn disposed outboard from the lateral end heat generation span Sh2 in the longitudinal direction of the lateral end heater 23*b*. In order to enhance a reflection efficiency in reflecting light emitted from the lateral end heater 23*b* to the fixing belt 21, the reflector 27 includes an outboard end 27out disposed outboard from the lateral end heat generation span Sh2 and the outboard end 242out of the thermal equalizer 242 in the longitudinal direction of the thermal equalizer 242 to facilitate temperature increase of each lateral end of the fixing belt 21 in the axial direction thereof together with the thermal equalizer 242.

Figure 8:
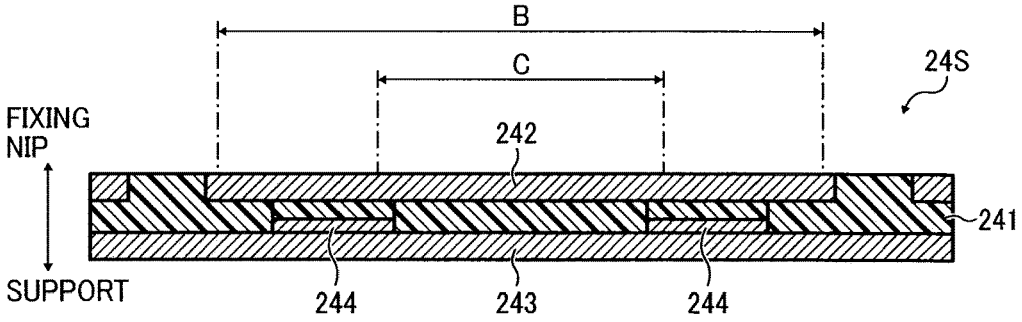
FIG. 8 is a cross-sectional view of a nip formation pad as a variation of the nip formation pad depicted in FIG. 4.
Figure 9:
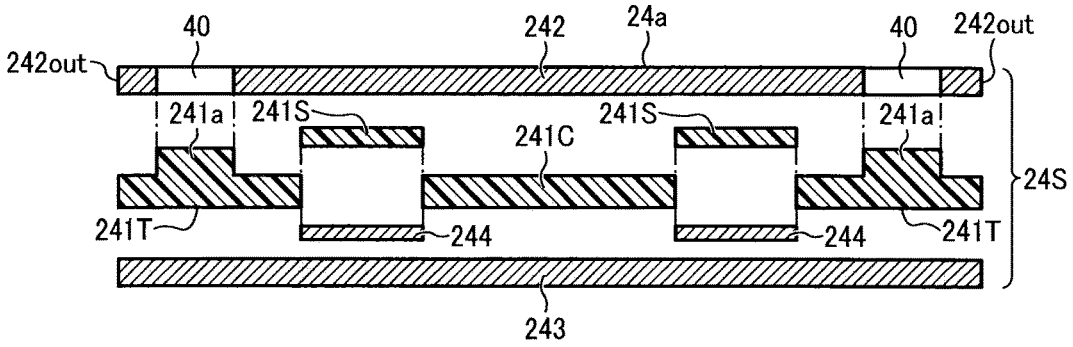
FIG. 9 is an exploded view of the nip formation pad depicted in FIG. 8.

A description is provided of a construction of a nip formation pad 24S as a variation of the nip formation pad 24. FIG. 8 is a cross-sectional view of the nip formation pad 24S. FIG. 9 is an exploded view of the nip formation pad 24S. As illustrated in FIG. 9, the nip formation pad 24S includes a slot 40 disposed in proximity to the outboard end 242out of the thermal equalizer 242. A projection 241*a* projecting from the lateral end portion 241T of the base 241 engages the slot 40 to define the entirely planar, fixing nip side face 24*a* of nip formation pad 24S. The slot 40 decreases an area where the thermal equalizer 242 contacts the fixing belt 21, reduces heat conduction from a portion provided with the slot 40 outward in the longitudinal direction of the thermal equalizer 242, and adjusts an amount heat conducted to the grip portion 22*a* serving as the increased tackiness portion, thus suppressing excessive conduction of heat to each lateral end of the fixing belt 21 in the axial direction thereof and resultant temperature increase of the fixing belt 21 when the image forming apparatus 1 is powered on in the morning, for example.

As illustrated in FIG. 7, an outboard edge 40*b* of the slot 40 is disposed outboard from an outboard edge 22*a*2 of the grip portion 22*a* that defines a lateral edge of the pressure roller 22 in the axial direction of the pressure roller 22. An inboard edge 40*a* of the slot 40 in the longitudinal direction of the thermal equalizer 242 corresponds to or is disposed opposite an inboard edge 22*a*1 of the grip portion 22*a* in the axial direction of the pressure roller 22. The inboard edge 40*a* of the slot 40 substantially defines an outboard edge of the thermal equalizer 242 in the longitudinal direction thereof. The inboard edge 40*a* of the slot 40 is disposed outboard from the conveyance span B corresponding to the width of the maximum size sheet available in the image forming apparatus 1 (e.g., an A3 extension size sheet having a width of 320 mm).

A stationary shield 42 is disposed opposite each lateral end of the lateral end heater 23*b* in the longitudinal direction thereof to shield the fixing belt 21 from light or heat radiated from the lateral end heater 23*b*. The stationary shield 42 is disposed outboard from the grip portion 22*a* in the longitudinal direction of the thermal equalizer 242 to facilitate temperature increase of each lateral end of the fixing belt 21 in the axial direction thereof together with the thermal equalizer 242. A heater holder 23*c* is secured to the flange 26*a* of the holder 26 together with the stationary shield 42 and the support 25. The heater holder 23*c* supports the center heater 23*a* and the lateral end heater 23*b* at each lateral end of the center heater 23*a* and the lateral end heater 23*b* in a longitudinal direction thereof. An inboard edge 26*a*1 of the flange 26*a* is disposed inboard from an outboard edge 42*b* of the stationary shield 42 and the heater holder 23*c* in the axial direction of the fixing belt 21.

According to the exemplary embodiment described above, the grip portion 22*a* is produced by removing the release layer and exposing the elastic layer of the pressure roller 22. Alternatively, in order to address decrease in friction coefficient over time, the grip portion 22*a* may be replaced with new one as described below.

A description is provided of a construction of a pressure roller 22S according to another exemplary embodiment that incorporates a replaceable grip portion 50.

Figure 10:
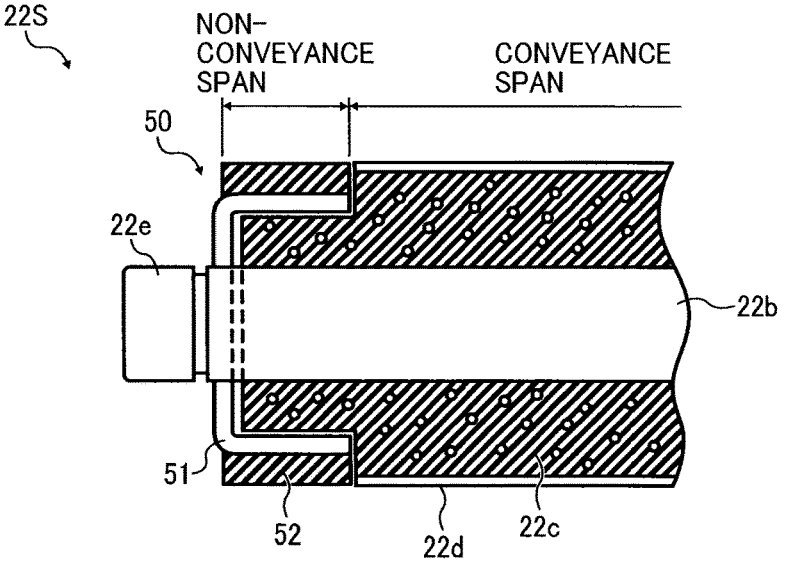
FIG. 10 is a partial cross-sectional view of a pressure roller as a variation of the pressure roller depicted in FIG. 7.
Figure 11:
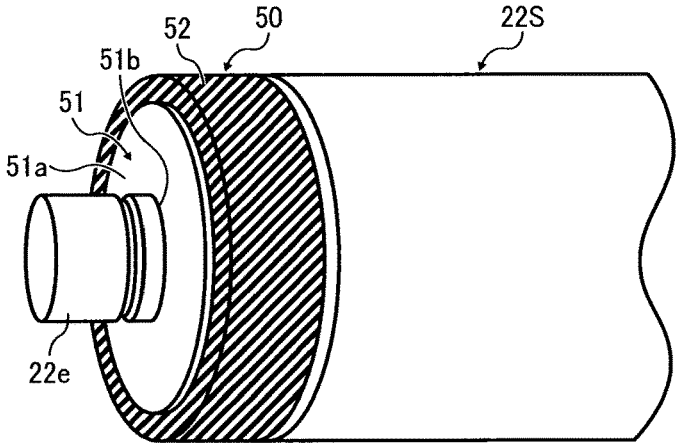
FIG. 11 is a partial perspective view of the pressure roller depicted in FIG. 10.

FIG. 10 is a partial cross-sectional view of the pressure roller 22S. FIG. 11 is a partial perspective view of the pressure roller 22S. As illustrated in FIG. 10, the pressure roller 22S includes a solid body constructed of a cored bar 22*b*, an elastic layer 22*c* coating the cored bar 22*b*, and a release layer 22*d* coating the elastic layer 22*c* and made of fluoro resin. The pressure roller 22S further includes a roller shaft 22*e* mounted on each lateral end of the cored bar 22*b* and extended in an axial direction of the pressure roller 22S. A part of the elastic layer 22*c* is extended to the grip portion 50 in the axial direction of the pressure roller 22S and disposed opposite an inner circumferential surface of the grip portion 50. The grip portion 50 is disposed outboard from a conveyance span where the sheet P is conveyed over the pressure roller 22S and disposed opposite a non-conveyance span where the sheet P is not conveyed over the pressure roller 22S.

The grip portion 50 serving as an increased tackiness portion is constructed of a base 51 and an elastic layer 52 mounted on an outer circumferential surface of the base 51. The base 51 is molded into at least a tube and made of metal such as iron, aluminum, and stainless steel or heat resistant resin such as PPS and polyethyleneterephthalate (PET). The elastic layer 52 is made of silicone rubber or the like. The silicone rubber of the elastic layer 52 is made of a material having a relatively low elasticity and a relatively high tackiness. Alternatively, the base 51 may be molded into a cylinder, a cup, or the like. According to this exemplary embodiment, the base 51 is a cup as illustrated in FIG. 11. The cup of the base 51 has a bottom 51*a* and a through-hole 51*b* through which the roller shaft 22*e* penetrates.

The grip portion 50 is secured to the pressure roller 22S such that the pressure roller 22S and the grip portion 50 define a roller. As the driver 92 drives and rotates the roller shaft 22*e* of the pressure roller 22S, the grip portion 50 rotates with the pressure roller 22S as a part of the pressure roller 22S, thus transmitting a driving force to the fixing belt 21 contacting the pressure roller 22S. According to this exemplary embodiment, the through-hole 51*b* having a diameter substantially equivalent to a diameter of the roller shaft 22*e* penetrates the bottom 51*a* of the cup of the base 51 so that the roller shaft 22*e* is inserted into the through-hole 51*b*. A key groove serving as a detent is disposed on each of the bottom 51*a* and the through-hole 51*b*. The driving force is transmitted from the roller shaft 22*e* to the grip portion 50 through the key groove.

Alternatively, an outer diameter of an extension section of the elastic layer 22*c* that is disposed opposite the inner circumferential surface of the grip portion 50 may be substantially equivalent to an inner diameter of the cup of the base 51. As the extension section of the elastic layer 22*c* is press-fitted into the cup of the base 51, a body of the pressure roller 22S engages the grip portion 50. The roller shaft 22*e* may mount a C-shaped ring groove. After the grip portion 50 is attached to the pressure roller 22S, a C-shaped ring is attached to the C-shaped ring groove to prevent the grip portion 50 from moving in the axial direction of the pressure roller 22S and dropping off the pressure roller 22S.

A description is provided of a construction of a pressure roller 22T according to yet another exemplary embodiment.

Figure 12A:
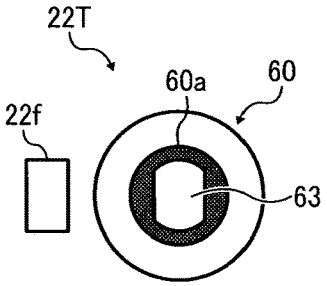
FIG. 12A is a cross-sectional view of the pressure roller as another variation of the pressure roller depicted in FIG. 7.
Figure 12B:
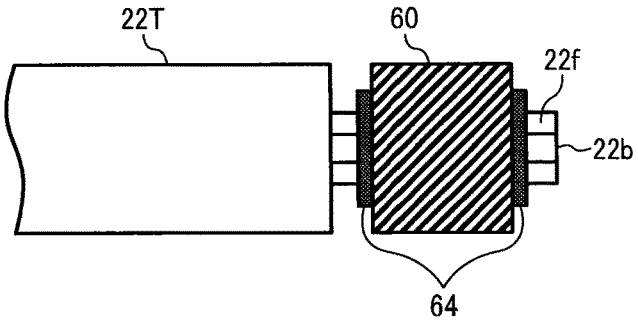
FIG. 12B is a side view of the pressure roller depicted in FIG. 12A.

FIG. 12A is a cross-sectional view of the pressure roller 22T. FIG. 12B is a side view of the pressure roller 22T. The pressure roller 22T includes a replaceable increased tackiness portion. As illustrated in FIGS. 12A and 12B, an H-cut portion 22*f* (e.g., an oval portion) is disposed at each lateral end of the cored bar 22*b* of the pressure roller 22T in an axial direction thereof. A grip portion 60 serving as an increased tackiness portion is disposed at each lateral end of the pressure roller 22T in the axial direction thereof. As illustrated in FIG. 12A, the grip portion 60 includes a through-hole 60*a* that engages the cored bar 22*b* and includes an H-cut portion 63 that fits the H-cut portion 22*f* of the cored bar 22*b*. As the through-hole 60*a* of the grip portion 60 is fitted on the cored bar 22*b*, the grip portion 60 is secured to the cored bar 22*b* in a circumferential direction of the pressure roller 22T. As illustrated in FIG. 12B, a fastener 64 (e.g., an E-shaped ring and a C-shaped ring) secures the grip portion 60 to the cored bar 22*b* in the axial direction of the pressure roller 22T.

Accordingly, the grip portion 60 is detachably attached to the pressure roller 22T so that the grip portion 60 is replaced with new one.

Even if the fixing device 20 incorporates the thermal equalizer 242 that heats the increased tackiness portion (e.g., the grip portions 22*a*, 50, and 60), after a plurality of sheets P is conveyed through the fixing device 20 continuously for a long time, the increased tackiness portion may be heated to a temperature at which the increased tackiness portion is susceptible to hardening. In this case, that is, when a plurality of sheets P of a predetermined number or greater is conveyed through the fixing device 20 continuously, the controller 90 controls a conveyor (e.g., the registration roller pair 12 depicted in FIGS. 1 and 3) to convey the sheets P with an increased interval between a preceding sheet P and a subsequent sheet P to decrease output of the heater 23 per unit time, thus suppressing temperature increase of the increased tackiness portion and preventing hardening of the increased tackiness portion which may degrade grip of the increased tackiness portion.

A description is provided of a construction of a fixing device 20S according to a second exemplary embodiment.

Figure 13:
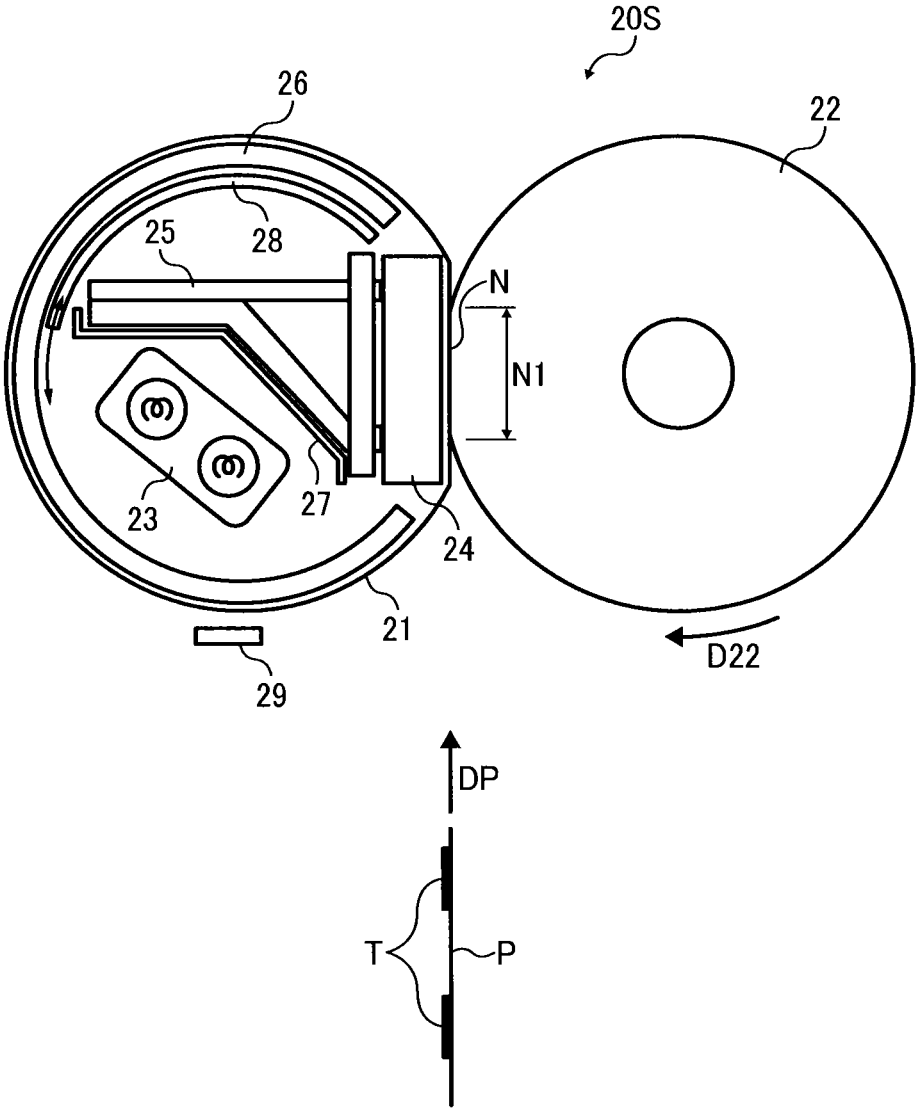
FIG. 13 is a schematic vertical cross-sectional view of a fixing device according to a second exemplary embodiment of the present disclosure.

FIG. 13 is a schematic vertical cross-sectional view of the fixing device 20S that corresponds to FIG. 2. Identical reference numerals are assigned to components identical to the components incorporated in the fixing device 20 illustrated in FIG. 2. A description of the identical components is omitted and a construction of the fixing device 20S that is different from the above-described construction of the fixing device 20 is described below.

Figure 14A:
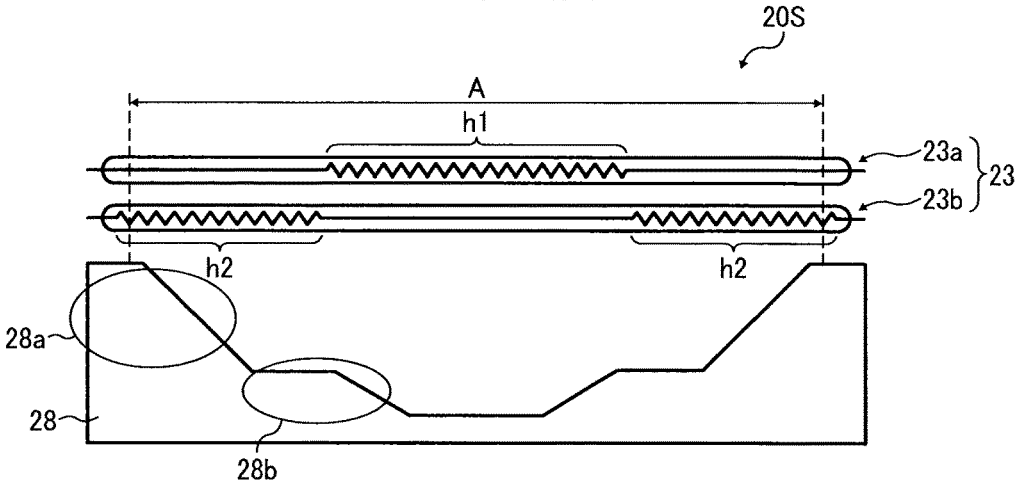
FIG. 14A is a diagram of the fixing device depicted in FIG. 13 illustrating a standby position of a movable shield incorporated in the fixing device.

As illustrated in FIG. 13, the fixing device 20S includes a movable shield 28 disposed opposite the inner circumferential surface of the fixing belt 21 and movable or pivotable in a circumferential direction of the fixing belt 21 while the movable shield 28 is isolated from the fixing belt 21. FIG. 14A is a diagram of the fixing device 20S illustrating a positional relation between the movable shield 28 and the heater 23. As illustrated in FIG. 14A, the movable shield 28 has a plurality of steps. For example, the movable shield 28 includes an outboard shield portion 28*a* and an inboard shield portion 28*b*. When a large sheet P (e.g., an A3 size sheet in portrait orientation) is conveyed through the fixing device 20S, the outboard shield portion 28*a* shields the fixing belt 21 from the heater 23 in an outboard span of the fixing belt 21 that is outboard from the large sheet P in the axial direction of the fixing belt 21. When a small sheet P (e.g., an A4 size sheet in portrait orientation) is conveyed through the fixing device 20S, the outboard shield portion 28*a* and the inboard shield portion 28*b* shield the fixing belt 21 from the heater 23 in the outboard span and an inboard span of the fixing belt 21 that are outboard from the small sheet P in the axial direction of the fixing belt 21. The movable shield 28 is selectively pivoted to a plurality of shield positions according to the size of the sheet P conveyed through the fixing device 20S, shielding the fixing belt 21 from the heater 23 in an axial span of the fixing belt 21 where heating of the fixing belt 21 is unnecessary.

Figure 14B:
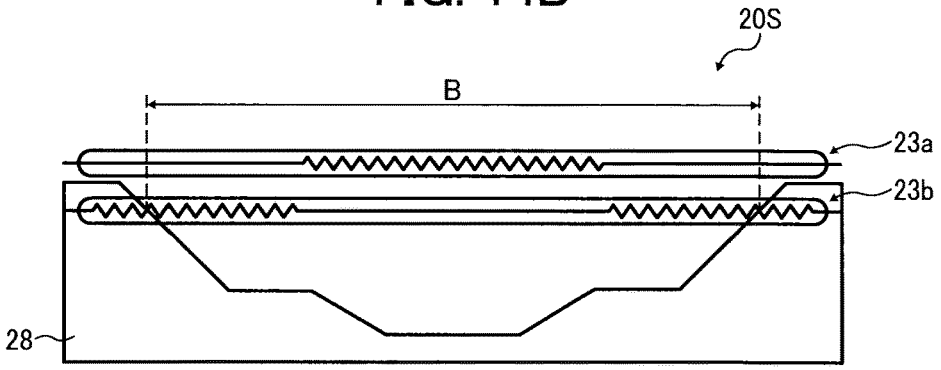
FIG. 14B is a diagram of the fixing device depicted in FIG. 13 illustrating a first shield position of the movable shield.
Figure 14C:
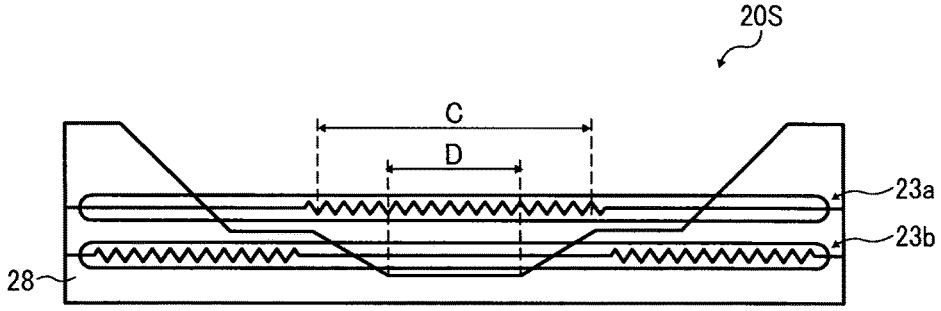
FIG. 14C is a diagram of the fixing device depicted in FIG. 13 illustrating a second shield position of the movable shield.

FIGS. 14A, 14B, and 14C illustrate a plurality of positions of the movable shield 28 that moves according to the width of the sheet P conveyed through the fixing device 20S. FIG. 14A illustrates a conveyance span A where the A3 extension size sheet is conveyed. The conveyance span A corresponds to a width of the A3 extension size sheet. When the A3 extension size sheet is conveyed through the fixing device 20S, the movable shield 28 moves to a standby position illustrated in FIG. 14A where the heater 23 is exposed to the fixing belt 21 in a greatest axial span of the fixing belt 21. The center heater 23*a* and the lateral end heater 23*b* are energized to cause a center heat generator h1 situated at a center span of the fixing belt 21 in the axial direction thereof and the lateral end heat generator h2 situated at each lateral end span of the fixing belt 21 in the axial direction thereof to generate heat. Accordingly, the center heater 23*a* and the lateral end heater 23*b* heat the thermal equalizer 242 throughout the entire width of the thermal equalizer 242 including each lateral end span of the thermal equalizer 242 in the longitudinal direction thereof so that the thermal equalizer 242 heats the grip portion 22*a* of the pressure roller 22 quickly.

FIG. 14B is a diagram of the fixing device 20S illustrating a first shield position of the movable shield 28. FIG. 14B illustrates the conveyance span B where the A3 size sheet is conveyed. The conveyance span B corresponds to a width of the A3 size sheet in portrait orientation. When the A3 size sheet in portrait orientation is conveyed through the fixing device 20S, the center heater 23*a* and the lateral end heater 23*b* are energized to cause the center heat generator h1 and the lateral end heat generator h2 to generate heat. The movable shield 28 moves slightly upward in FIG. 14A from the standby position to the first shield position illustrated in FIG. 14B. Accordingly, the movable shield 28 shields the fixing belt 21 from the lateral end heater 23*b* in an outboard span of the lateral end heat generator h2 that is outboard from the conveyance span B of the A3 size sheet in portrait orientation. Consequently, the center heater 23*a* and the lateral end heater 23*b* heat the fixing belt 21 in the conveyance span B corresponding to the width of the A3 size sheet in portrait orientation.

FIG. 14C is a diagram of the fixing device 20S illustrating a second shield position of the movable shield 28. FIG. 14C illustrates the conveyance span C where the A4 size sheet is conveyed. The conveyance span C corresponds to a width of the A4 size sheet in portrait orientation. When the A4 size sheet in portrait orientation is conveyed through the fixing device 20S, the center heater 23*a* is energized to cause the center heat generator h1 to generate heat. The movable shield 28 moves slightly upward in FIG. 14B from the first shield position to the second shield position illustrated in FIG. 14C, shielding the fixing belt 21 from the lateral end heat generator h2 of the lateral end heater 23*b*. Accordingly, even if sheets P of various sizes are conveyed through the fixing device 20S continuously, the movable shield 28 shields the fixing belt 21 from the lateral end heater 23*b* more effectively by blocking remaining heat from the lateral end heater 23*b* compared to shielding by powering off the lateral end heater 23*b*, thus preventing the heater 23 from heating the fixing belt 21 and the pressure roller 22 unnecessarily.

FIG. 14C illustrates a conveyance span D where a postcard is conveyed. The conveyance span D corresponds to a width of the postcard. When the postcard is conveyed through the fixing device 20S, the center heater 23*a* is energized to cause the center heat generator h1 to generate heat. The movable shield 28 moves upward in FIG. 14C from the second shield position to shield the fixing belt 21 from each lateral end of the center heat generator h1 of the center heater 23*a* in the axial direction of the fixing belt 21.

When the fixing device 20S is warmed up before the sheets P of various sizes are conveyed through the fixing device 20S, the movable shield 28 is at the standby position depicted in FIG. 14A so that the center heater 23*a* and the lateral end heater 23*b* are energized to heat the grip portion 22*a* of the pressure roller 22. Thereafter, the movable shield 28 moves to the first shield position or the second shield position according to the size of the sheet P. When the plurality of sheets P is conveyed through the fixing device 20S continuously, the movable shield 28 may move gradually to prevent the grip portion 22*a* of the pressure roller 22 from overheating to a temperature at which the grip portion 22*a* is susceptible to hardening.

Alternatively, instead of the outboard shield portion 28*a* and the inboard shield portion 28*b*, the movable shield 28 may include a slope angled relative to the axial direction of the fixing belt 21 to shield the fixing belt 21 from the heater 23 in various axial spans that vary depending on the width of the sheet P. Accordingly, it is not necessary to change the number of heaters according to the total number of sizes of sheets P available in the fixing device 20S. For example, it is sufficient for the fixing device 20S to incorporate the two heaters, that is, the center heater 23*a* and the lateral end heater 23*b*. While the movable shield 28 restricts direct heating by the heater 23 of the non-conveyance span of the fixing belt 21 where the sheet P is not conveyed over the fixing belt 21, the thermal equalizers 242 to 244 equalize heat accumulated in the fixing belt 21 in the axial direction thereof to heat the grip portion 22*a* of the pressure roller 22 appropriately, thus achieving tackiness of the grip portion 22*a*.

A description is provided of a construction of a fixing device 20T according to a third exemplary embodiment.

Figure 15:
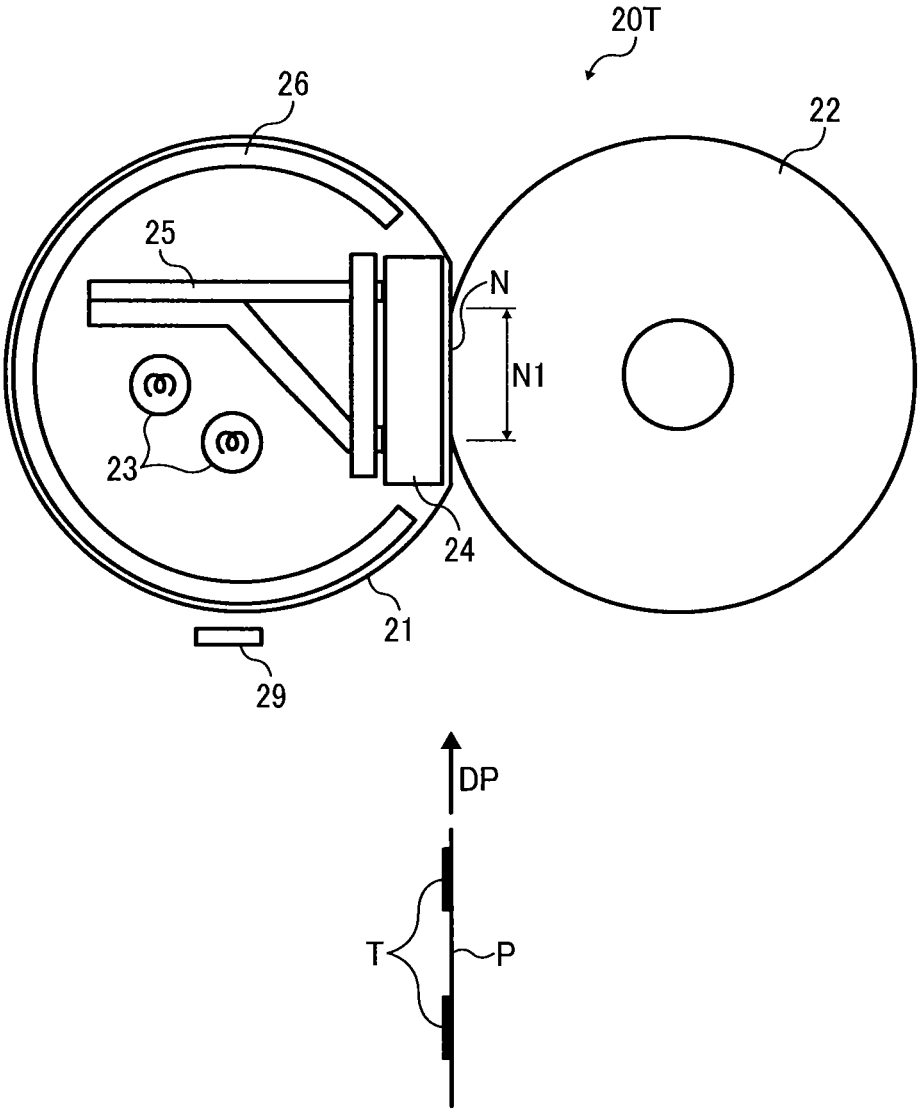
FIG. 15 is a schematic vertical cross-sectional view of a fixing device according to a third exemplary embodiment of the present disclosure.

FIG. 15 is a schematic vertical cross-sectional view of the fixing device 20T that corresponds to FIGS. 2 and 13.

Identical reference numerals are assigned to components identical to the components incorporated in the fixing devices 20 and 20S illustrated in FIGS. 2 and 13, respectively. A description of the identical components is omitted and a construction of the fixing device 20T that is different from the above-described construction of the fixing devices 20 and 20S is described below. The fixing device 20T has a construction to address a restricted space inside the loop formed by the fixing belt 21. Instead of the reflector 27 interposed between the heater 23 and the support 25, a heater side face of the support 25 that is disposed opposite the heater 23 is treated with mirror finishing to reflect light emitted from the heater 23 toward the fixing belt 21, thus preventing radiant heat or light radiated from the heater 23 from heating the support 25 and the like and suppressing waste of energy.

A description is provided of advantages of the fixing devices 20, 20S, and 20T.

As illustrated in FIGS. 2, 13, and 15, a fixing device (e.g., the fixing devices 20, 20S, and 20T) includes an endless belt (e.g., the fixing belt 21), a heater (e.g., the heater 23), a nip formation pad (e.g., the nip formation pad 24), and a pressure rotator (e.g., the pressure rollers 22, 22S, and 22T). The endless belt is formed into a loop and rotatable in a predetermined direction of rotation (e.g., the rotation direction D21). The heater is disposed opposite the endless belt to heat the endless belt. The nip formation pad is disposed inside the loop formed by the endless belt. The pressure rotator is rotatable in a predetermined direction of rotation (e.g., the rotation direction D22) and pressed against the nip formation pad via the endless belt to form the fixing nip N between the pressure rotator and the endless belt. As a recording medium (e.g., a sheet P) bearing an unfixed toner image (e.g., a toner image T) is conveyed through the fixing nip N, the endless belt and the pressure rotator fix the toner image on the recording medium under heat and pressure.

As illustrated in FIGS. 7, 10, and 12B, the pressure rotator includes an increased tackiness portion (e.g., the grip portions 22*a*, 50, and 60) disposed at a lateral end of the pressure rotator in an axial direction thereof to transmit a driving force to the endless belt.

As illustrated in FIG. 4, the nip formation pad includes a metallic thermal equalizer (e.g., the thermal equalizer 242) extending in an axial direction of the endless belt to define the fixing nip side face 24*a* disposed opposite the fixing nip N. The thermal equalizer is disposed opposite the increased tackiness portion of the pressure rotator.

For example, the thermal equalizer extends to constitute the fixing nip side face 24*a* of the nip formation pad that presses against the endless belt. The thermal equalizer is a metallic portion having an increased thermal conductivity to enhance heat conduction in a longitudinal direction of the nip formation pad parallel to the axial direction of the endless belt and transmit heat to the increased tackiness portion of the pressure rotator disposed at the lateral end of the pressure rotator in the axial direction thereof. Accordingly, the increased tackiness portion of the pressure rotator is heated appropriately to achieve a grip of the pressure rotator. Additionally, when a plurality of small recording media is conveyed through the fixing nip N continuously, the thermal equalizer prevents overheating of a non-conveyance span of the endless belt in the axial direction thereof where the small recording media are not conveyed and prevents the increased tackiness portion of the pressure rotator from overheating for an extended period of time.

Even if a plurality of small recording media, each of which has a decreased width, is conveyed through the fixing device continuously that incorporates the endless belt having a decreased thermal capacity, the pressure rotator contacting the endless belt is immune from thermal degradation and is capable of transmitting the driving force to the endless belt precisely.

According to the exemplary embodiments described above, the fixing belt 21 serves as an endless belt or a fixing rotator. Alternatively, a fixing film, a fixing sleeve, or the like may be used as an endless belt or a fixing rotator. Further, the pressure roller 22 serves as a pressure rotator. Alternatively, a pressure belt or the like may be used as a pressure rotator.

The present disclosure has been described above with reference to specific exemplary embodiments. Note that the present disclosure is not limited to the details of the embodiments described above, but various modifications and enhancements are possible without departing from the spirit and scope of the disclosure. It is therefore to be understood that the present disclosure may be practiced otherwise than as specifically described herein. For example, elements and/or features of different illustrative exemplary embodiments may be combined with each other and/or substituted for each other within the scope of the present disclosure.

What is claimed is:

1. A fixing device comprising:

a rotatable endless belt formed into a loop;

a heater disposed opposite the endless belt to heat the endless belt;

a nip formation pad disposed inside the loop formed by the endless belt, the nip formation pad including a metallic thermal equalizer extending in an axial direction of the endless belt;

a rotatable pressure rotator to press against the nip formation pad via the endless belt to form a fixing nip between the endless belt and the pressure rotator, the fixing nip through which a recording medium bearing a toner image is conveyed; and a stationary shield interposed between the heater and the endless belt to shield the endless belt from light radiated from the heater, the stationary shield being disposed opposite each lateral end of the heater in the axial direction of the endless belt, wherein the pressure rotator including an increased tackiness portion disposed at a lateral end of the pressure rotator in an axial direction of the pressure rotator to transmit a driving force to the endless belt, the increased tackiness portion being disposed opposite the thermal equalizer of the nip formation pad, wherein the stationary shield is disposed outboard from the increased tackiness portion of the pressure rotator in the axial direction of the pressure rotator, wherein at least a part of the stationary shield is disposed outboard from the thermal equalizer of the nip formation pad in the axial direction of the pressure rotator, and wherein the thermal equalizer includes a slot disposed at a lateral end of the thermal equalizer in the axial direction of the endless belt, an outboard edge of the slot being disposed outboard from an outboard edge of the increased tackiness portion of the pressure rotator in the axial direction of the pressure rotator.

2. The fixing device according to claim 1, wherein the thermal equalizer defines a fixing nip side face of the nip formation pad that is disposed opposite the fixing nip.

3. The fixing device according to claim 1,
wherein the heater includes a lateral end heat generator disposed at a lateral end of the heater in the axial direction of the endless belt, and
wherein the thermal equalizer bridges the lateral end heat generator and a non-heat generation span disposed outboard from the lateral end heat generator in the axial direction of the endless belt.

4. The fixing device according to claim 3,
wherein the heater further includes a center heat generator disposed at a center of the heater in the axial direction of the endless belt, and
wherein a heat generation amount of the lateral end heat generator is greater than a heat generation amount of the center heat generator.

5. The fixing device according to claim 1,
wherein the increased tackiness portion of the pressure rotator is disposed outboard from a conveyance span of the pressure rotator where the recording medium of a maximum size is conveyed over the pressure rotator in the axial direction of the pressure rotator.

6. The fixing device according to claim 1, further comprising:
a movable shield interposed between the heater and the endless belt to shield the endless belt from light radiated from the heater.

7. The fixing device according to claim 6,
wherein the movable shield moves in a circumferential direction of the endless belt to a standby position where the movable shield does not shield the endless belt from the heater when the fixing device is warmed up.

8. The fixing device according to claim 7,
wherein a decreased rotation speed of the pressure rotator when the fixing device is warmed up is lower than an increased rotation speed of the pressure rotator when the recording medium is conveyed through the fixing device.

9. The fixing device according to claim 8,
wherein the pressure rotator rotates at the decreased rotation speed for a period of time that increases as an environmental temperature decreases.

10. The fixing device according to claim 6,
wherein the movable shield moves gradually to increase a shield area where the movable shield shields the endless belt from the heater when a plurality of recording media is conveyed through the fixing nip continuously.

11. The fixing device according to claim 1,
wherein when a plurality of recording media of a predetermined number or greater is conveyed through the fixing device continuously, the plurality of recording media is conveyed with an increased interval between a preceding recording medium and a subsequent recording medium.

12. The fixing device according to claim 1, further comprising:
a reflector, disposed opposite the endless belt via the heater, to reflect light radiated from the heater to the endless belt, the reflector including an outboard end disposed outboard from the increased tackiness portion of the pressure rotator in the axial direction of the pressure rotator.

13. The fixing device according to claim 1,
wherein the increased tackiness portion of the pressure rotator is made of rubber.

14. The fixing device according to claim 1,
wherein the increased tackiness portion of the pressure rotator includes:
a base; and
an elastic layer mounted on an outer circumferential surface of the base.

15. The fixing device according to claim 14,
wherein the base of the increased tackiness portion of the pressure rotator includes one of a cylinder and a cup.

16. The fixing device according to claim 1,
wherein the increased tackiness portion of the pressure rotator is detachably attached to the pressure rotator.

17. The fixing device according to claim 16,
wherein the pressure rotator further includes:
a cored bar mounting the increased tackiness portion; and
a fastener to secure the increased tackiness portion to the cored bar in the axial direction of the pressure rotator.

18. The fixing device according to claim 1, further comprising:
a holder which supports the heater and a stay which supports the nip formation pad,
wherein the holder includes a flange to which a heater holder is secured, and
wherein an inboard edge of the flange is disposed inboard from an outboard edge of the stationary shield and the heater holder in the axial direction of the fixing belt.

19. An image forming apparatus comprising:
an image forming device to form a toner image; and
a fixing device disposed downstream from the image forming device in a recording medium conveyance direction to fix the toner image on a recording medium,
the fixing device including:
a rotatable endless belt formed into a loop;
a heater disposed opposite the endless belt to heat the endless belt;
a nip formation pad disposed inside the loop formed by the endless belt, the nip formation pad including a metallic thermal equalizer extending in an axial direction of the endless belt;
a rotatable pressure rotator to press against the nip formation pad via the endless belt to form a fixing nip between the endless belt and the pressure rotator, the fixing nip through which the recording medium bearing the toner image is conveyed; and
a stationary shield interposed between the heater and the endless belt to shield the endless belt from light radiated from the heater, the stationary shield being disposed opposite each lateral end of the heater in the axial direction of the endless belt,
wherein, the pressure rotator including an increased tackiness portion disposed at a lateral end of the pressure rotator in an axial direction of the pressure rotator to transmit a driving force to the endless belt, the increased tackiness portion being disposed opposite the thermal equalizer of the nip formation pad,
wherein the stationary shield is disposed outboard from the increased tackiness portion of the pressure rotator in the axial direction of the pressure rotator,
wherein at least a part of the stationary shield is disposed outboard from the thermal equalizer of the nip formation pad in the axial direction of the pressure rotator, and
wherein the thermal equalizer includes a slot disposed at a lateral end of the thermal equalizer in the axial direction of the endless belt, an outboard edge of the slot being disposed outboard from an outboard edge of the increased tackiness portion of the pressure rotator in the axial direction of the pressure rotator.

* * * * *